US009284175B2

(12) United States Patent
Levy et al.

(10) Patent No.: US 9,284,175 B2
(45) Date of Patent: Mar. 15, 2016

(54) COLLECTION FUNNEL

(71) Applicant: Navajo Manufacturing Company, Inc., Denver, CO (US)

(72) Inventors: Gordon Levy, Golden, CO (US); Ming Shan, Thornton, CO (US); David L. Martin, Highlands Ranch, CO (US)

(73) Assignee: NAVAJO MANUFACTURING COMPANY, INC., Denver, CO (US)

( * ) Notice: Subject to any disclaimer, the term of this patent is extended or adjusted under 35 U.S.C. 154(b) by 228 days.

(21) Appl. No.: 13/780,457

(22) Filed: Feb. 28, 2013

(65) Prior Publication Data

US 2014/0238538 A1 Aug. 28, 2014

(51) Int. Cl.
*B67C 11/02* (2006.01)

(52) U.S. Cl.
CPC ..... *B67C 11/02* (2013.01)

(58) Field of Classification Search
CPC ..... B63B 17/00; G01F 19/00; G01F 10/002; B67C 11/02
USPC ..... 141/334, 333, 332, 331, 342, 343, 297; D15/150; D23/200; D7/700
See application file for complete search history.

(56) References Cited

U.S. PATENT DOCUMENTS 192,987 A * 7/1877 Griffiths ..... 294/180
1,521,212 A * 12/1924 Allen ..... 141/334
2,179,400 A * 11/1939 Casner ..... B67C 11/02 141/334
3,490,501 A * 1/1970 Manem et al. ..... 141/84
D218,773 S * 9/1970 Sitts ..... D7/700
D230,629 S * 3/1974 Camp et al. ..... D7/414
3,899,012 A 8/1975 Sather
4,646,795 A * 3/1987 Hebron et al. ..... 141/98
5,092,471 A 3/1992 Pinizzotto et al.
5,377,728 A * 1/1995 McLeighton ..... 141/333
5,497,814 A 3/1996 Cannon
D415,662 S * 10/1999 Schneider ..... D7/700
6,098,678 A 8/2000 Shears
6,179,022 B1 1/2001 Schneider et al.
6,450,219 B1 9/2002 Ingram
D554,166 S * 10/2007 LaFollette ..... D15/152
D555,439 S 11/2007 Fletcher et al.
2012/0152408 A1 6/2012 Levy et al.

FOREIGN PATENT DOCUMENTS

GB 612851 * 11/1948
GB 2 266 251 A * 10/1993

* cited by examiner

*Primary Examiner* — Jason K Niesz
*Assistant Examiner* — James Hakomaki
(74) *Attorney, Agent, or Firm* — Studebaker & Brackett PC

(57) ABSTRACT

A funnel having a collection area disposed at one end of the funnel. A base surface of the collection area is flat. A flange surrounding an inlet opening is positioned spaced from the collection area. When the funnel is placed in a vertical orientation with the base surface of the collection area contacting a horizontal surface, a lowermost edge of the flange surrounding the inlet opening is aligned with the base surface of the collection area. The funnel is thereby supported in a vertical orientation on the horizontal surface by two contact points. In this position, the residual fluid in the funnel is transferred by gravity to collect within the collection area. No residual fluid is allowed to escape from the interior of the funnel.

8 Claims, 6 Drawing Sheets

COLLECTION FUNNEL

FIELD OF THE INVENTION

The present invention relates to the field of collection of viscous fluids, whether in a kitchen or automobile environment.

BACKGROUND OF THE INVENTION

Often times, a funnel is used to transfer fluids from a container into another receptacle. This may include the transfer of automobile oil to the engine of the automobile. Alternatively, cooking fluids are often times required to be transferred from a large container into a smaller container.

The concept is the same in either environment in that a fluid is transferred by a funnel through a large intake opening into a small outlet opening for communication with a downstream receptacle. When this transfer is complete, the funnel used often collects a residue of fluid between the funnel's larger intake opening and its smaller outlet opening. Unless a cloth or paper towel is used to clean the interior of the funnel, the fluid collects in the funnel and is ultimately allowed to drip from the outlet opening.

This residual fluid then must be dealt with after the fluid has been allowed to be transferred to an unintended location. In addition, if a transfer tube remains connected to the outlet opening, the free end of the tube is also allowed to transfer residual fluid along an unintended path.

SUMMARY OF THE INVENTION

It is therefore an object of the present invention to collect all residual fluid remaining in the interior of a funnel between an inlet opening and an outlet opening.

This object is obtained by a funnel having a collection area disposed at one end of the funnel. A base surface of the collection area is flat. A flange surrounding the inlet opening is positioned spaced from the collection area. When the funnel is placed in a vertical orientation with the base surface of the collection area contacting a horizontal surface, a lowermost edge of the flange surrounding the inlet opening is aligned with the base surface of the collection area. The funnel is thereby supported in a vertical orientation on the horizontal surface by two contact points.

In this position, the residual fluid in the funnel is transferred by gravity to collect within the collection area. No residual fluid is allowed to escape from the interior of the funnel. A hanging opening is provided in the upper portion of the flange for hanging of the funnel on a hook or nail protruding from a vertical surface.

Accordingly, it is another object of the present invention to provide a collection funnel for collecting residual fluid contained between an inlet opening and an outlet opening so as to prevent the escape of residual fluid from the funnel.

It is yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid.

It is still yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid with the collection area defining a base surface to support the funnel in a vertical orientation when the funnel is placed upon a horizontal surface.

It is still yet another object of the present invention to provide a collection funnel for collecting residual fluid contained between an inlet opening and an outlet opening so as to prevent the escape of residual fluid from the funnel with the funnel including a collection area at a base portion of the funnel for collecting the residual fluid with the collection area defining a base surface to support the funnel in a vertical orientation when the funnel is placed upon a horizontal surface with the base surface of the collection area cooperating with a lower most surface of a flange surrounding the inlet opening to stabilize the funnel in a vertical orientation at two contact points.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
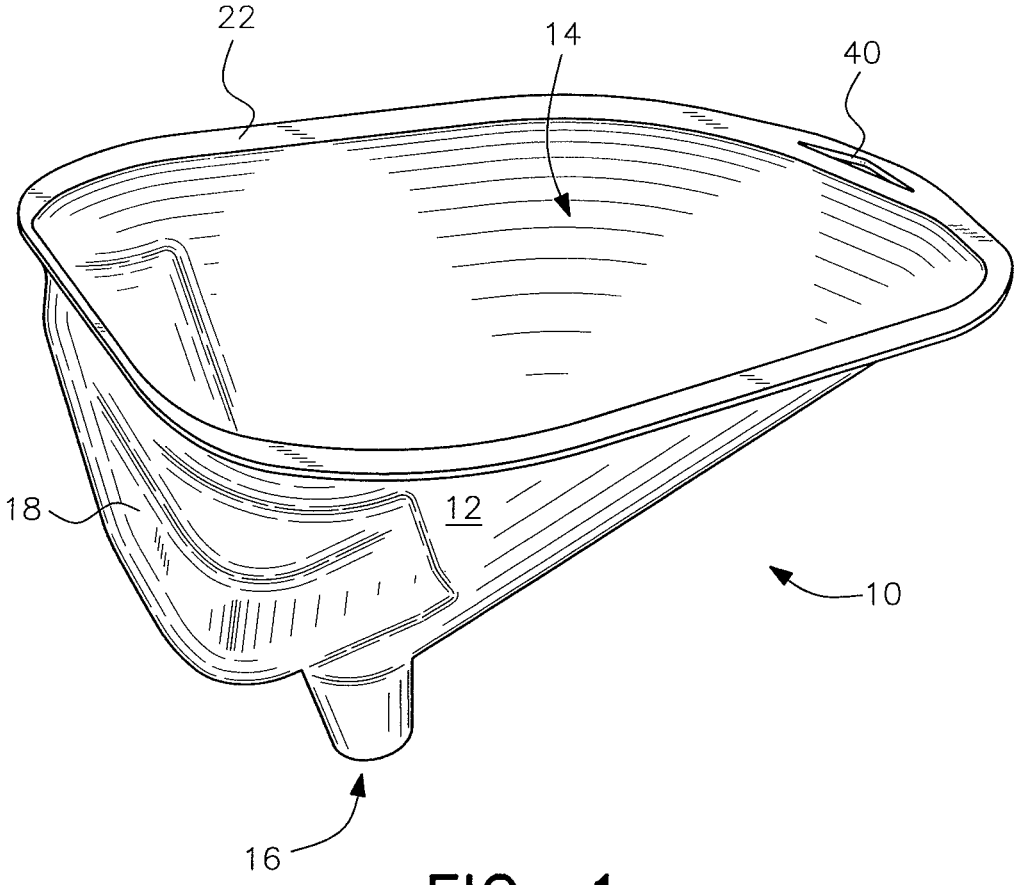
FIG. 1 is a perspective view of the collection funnel of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
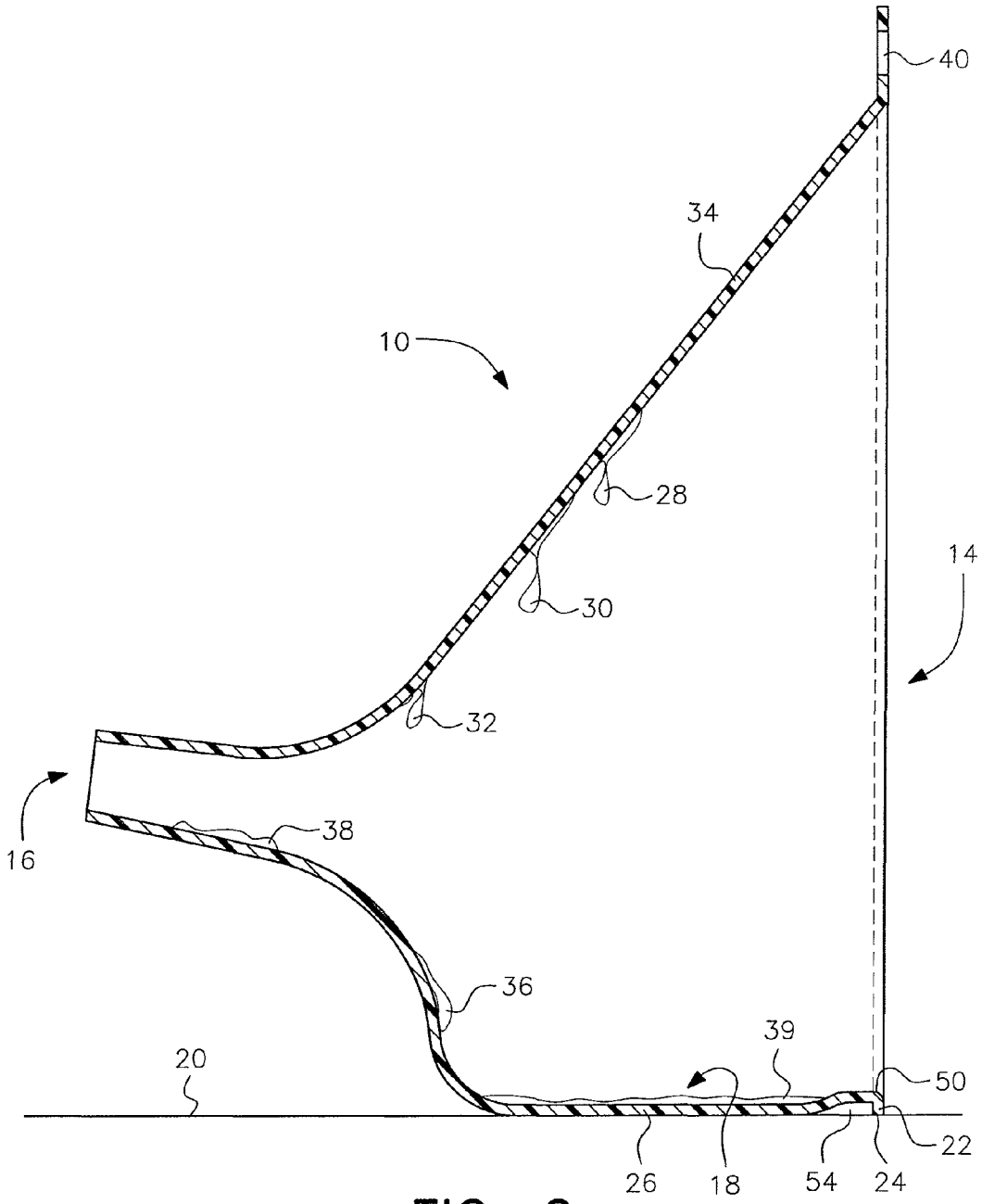
FIG. 2 is a cross-sectional view of the collection funnel illustrating the funnel positioned on a horizontal surface for collection of residual fluid in a collection area.
Figure 3:
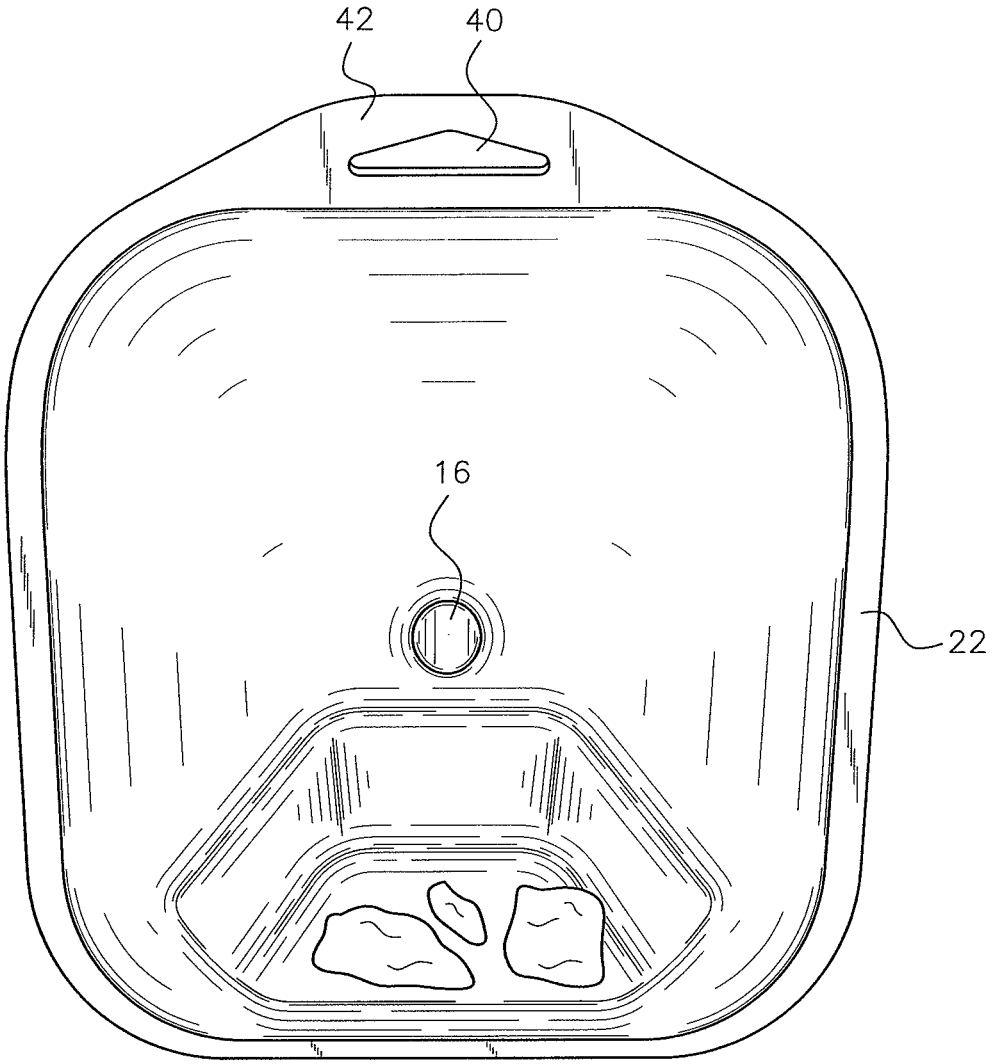
FIG. 3 is a front view of the collection funnel showing the collection of residual fluid in the collection area.
Figure 4:
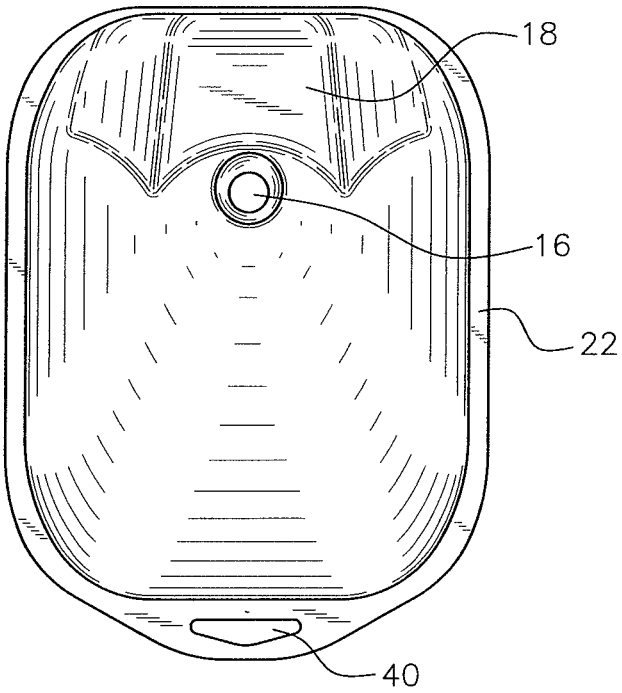
FIG. 4 is a top view of the collection funnel.
Figure 5:
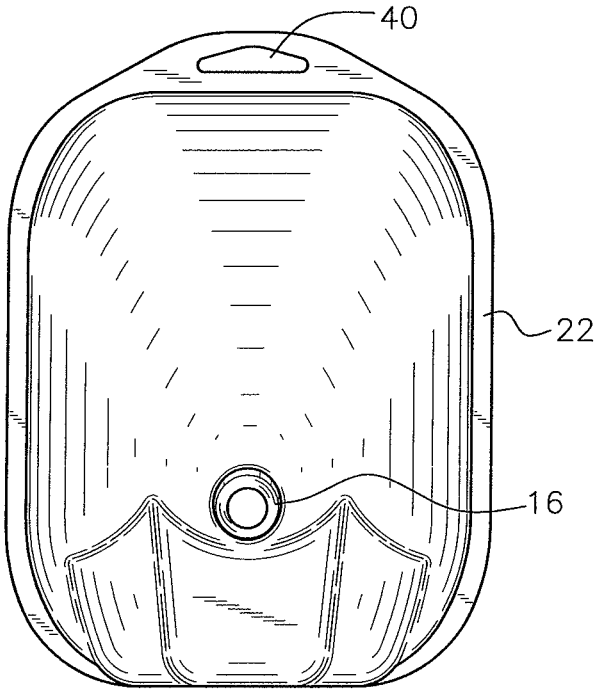
FIG. 5 is a bottom view of the collection funnel.
Figure 6:
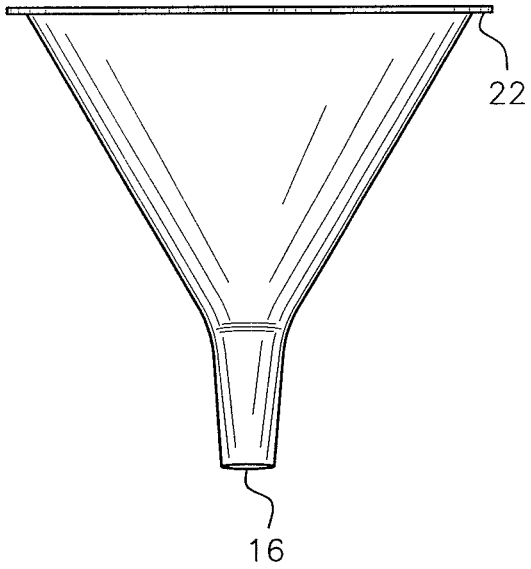
FIG. 6 is a front view of the collection funnel.
Figure 7:
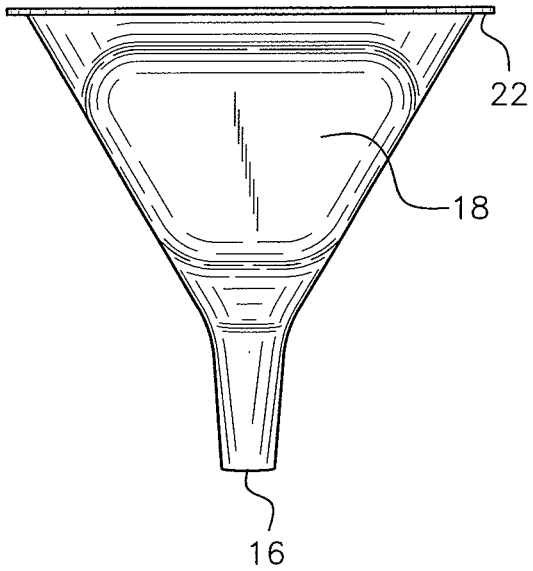
FIG. 7 is a rear view of the collection funnel.
Figure 8:
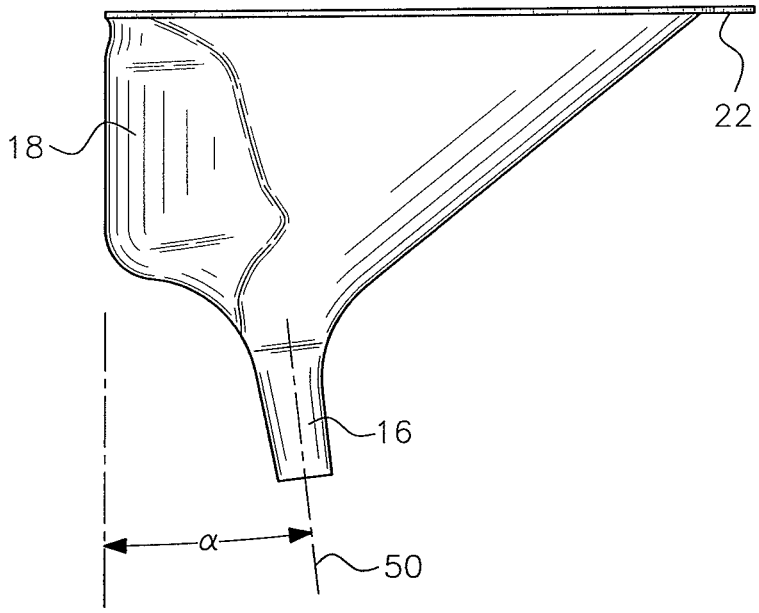
FIG. 8 is a side view of the collection funnel.

With reference to the drawings, in general, and to FIGS. 1 through 3, in particular, a collection funnel embodying the teachings of the subject invention is generally designated as 10. With reference to its orientation in FIG. 1, the collection funnel includes a body 12 having an inlet opening 14 and an outlet opening 16. Liquids are normally dispersed into the inlet opening 14 and after traveling through the body 12 of the funnel, exit the funnel through outlet opening 16.

As shown in FIG. 2, when the funnel 10 is finished being used, a collection area 18 is positioned on a horizontal surface 20 such as a counter top or working surface. Flange 22, which surrounds the inlet opening 14, includes a lower most edge portion 24 which is also moved into contact with the surface 20, so as to position the funnel in a vertical orientation. A lowermost base surface 26 of the collection area 18 also contacts the surface 20.

The collection area 18 is positioned at one end of the funnel to provide a bumped out portion of a funnel which is used to collect residual fluid in the funnel and stabilize the funnel in a vertical orientation. The depth of the collection area, below an uppermost edge of flange 22 is approximately ⅛ to ¼ of an inch. The width of the collection area is approximately three inches tapering down to a width of 1½ inches. The sidewalls of the collection area generally follow and are aligned with the converging sidewalls of the remainder of the body.

As shown in FIG. 2, residual fluid droplets 28, 30, 32 move along inclined surface 34 due to the force of gravity. In addition, residual fluid droplets 36, 38 also move along surfaces of the funnel by gravity. These droplets of residual fluid collect as residual fluid mass 39 at the bottom of collection area 18. By this mechanism, no additional steps need be taken to prevent residual fluid from leaking from the funnel located in a supported vertical orientation.

Alternatively, the funnel may be positioned along a vertical surface by passage of a nail or hook through an opening 40 in an upper portion 42 of the flange 22. In this instance, the flange 22, surrounding the inlet opening 14, functions to stabilize the funnel in a vertical orientation against a vertical surface for collection of residual fluid in the collection area 18.

As can be seen in the figures, collection area 18 has a depth of ¼ to ½ inch below the inner edge 50 of flange 22. This forms a recess for collection of a significant quantity of residual fluid, if necessary. By having a narrow gap 54 between the flange 22 and the collection area 18, the funnel 10 is very stable when positioned on a flat horizontal surface. A width of the gap 52 is approximately ½ inch.

In addition, outlet opening 16 is of a conical shape, tapering inwardly from the interior of the funnel towards its opening. A longitudinal axis 50 of the outlet opening is spaced approximately 1½ inches above the bottom surface 26.

The outlet opening is positioned at an angle with respect to the bottom surface 26 of the collection area 18. Typically, the angle of inclination $\propto$ is between 10° and 20°. This assists in the return of residue droplet 38 by gravity to the collection area 18.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A collection funnel comprising a body having an inlet opening and an outlet opening, an inclined surface located between the inlet opening and the outlet opening, a recessed collection area in the body for residual fluid, the recessed collection area being located between the inlet opening and the outlet opening of the body, a flange extending outwardly from at least a portion of said inlet opening, and a base surface of said recessed collection area, at least a first portion of the base surface being flat, a second portion of the base surface transitioning upwardly and inwardly from the flat first portion of the base surface to the inlet opening, the flat first portion of the base surface of the recessed collection area and an outwardly extending edge of the flange defining a plane having two support points for the body in a vertical orientation when the body is placed on a horizontal surface, the flat first portion of the base surface being configured to extend parallel to the horizontal surface and the second portion of the base surface being located above the flat first portion of the base surface when the body is vertically oriented on the horizontal surface, the outlet opening extending at an upwardly and outwardly angle with respect to the flat first portion of the base surface of the recessed collection area so that a longitudinal axis of the outlet opening extends up and is inclined away from a plane of the base surface of the recessed collection area, wherein when the funnel is placed on the horizontal surface, the inclined surface is located directly above the recessed collection area.

2. The collection funnel according to claim 1, wherein the flat first portion of the base surface is spaced from the flange.

3. The collection funnel according to claim 2, wherein the flat first portion of the base surface of the recessed collection area is located spaced below an upper edge of the flange.

4. The collection funnel according to claim 1, wherein the flat first portion of the base surface is spaced from the flange by a gap.

5. The collection funnel according to claim 4, wherein the gap has a width of ½ inch.

6. The collection funnel according to claim 1, wherein the angle the outlet opening extends at with respect to the flat first portion of the base surface is in the range of 10° to 20°.

7. A collection funnel comprising a body having an inlet opening and an outlet opening, the inlet opening having an inwardly extending inner edge, an inclined surface located between the inlet opening and the outlet opening, a recessed collection area for residual fluid, the recessed collection area being located between the inwardly extending inner edge of the inlet opening and the outlet opening of the body, and a base surface of said recessed collection area, at least a portion of the base surface being flat, the base surface of the recessed collection area defining a horizontal surface for supporting the body in a vertical orientation when the base surface is placed on a horizontal surface, the outlet opening extending at an upwardly and outwardly angle with respect to the base surface of the recessed collection area so that a longitudinal axis of the outlet opening extends up and is inclined away from a plane of the base surface of the recessed collection area, wherein when the funnel is placed on the horizontal surface, the inclined surface is located directly above the recessed collection area.

8. The collection funnel according to claim 7, wherein the outlet opening extends at an angle of 10° to 20° with respect to the base surface.

* * * * *